United States Patent [19]

Salem

[11] Patent Number: 4,782,793

[45] Date of Patent: Nov. 8, 1988

[54] FOSSIL-FUEL FIRED VAPOR GENERATOR

[75] Inventor: Abdulla Salem, Seuzach, Switzerland

[73] Assignee: Sulzer Brothers Limited, Winterthur, Switzerland

[21] Appl. No.: 898,693

[22] Filed: Aug. 21, 1986

[30] Foreign Application Priority Data

Sep. 23, 1985 [CH] Switzerland ..... 4110/85

[51] Int. Cl.[4] ..... F22B 37/00

[52] U.S. Cl. ..... 122/6 A; 122/235 A; 122/235 C; 122/235 K

[58] Field of Search ..... 110/233, 234; 122/6 R, 122/6 A, 235 R, 235 A, 235 C, 235 K, 235 N, 332, 355, 359, 468, 463, 511–512, 135 R, 155 R, 156, 318; 165/168, 169, 177; 285/150

[56] References Cited

U.S. PATENT DOCUMENTS

| | | | |
|---|---|---|---|
| 3,832,978 | 9/1974 | Brunner | 122/6 A |
| 3,832,979 | 9/1974 | Ammann | 122/6 A |
| 3,868,927 | 3/1975 | Losel et al. | 122/6 A X |
| 4,123,994 | 11/1978 | Gersch et al. | 122/6 A |
| 4,178,881 | 12/1979 | Pratt et al. | 122/235 A |
| 4,473,035 | 9/1984 | Gorzegno | 122/235 C X |
| 4,537,156 | 8/1985 | Rees | 122/6 A |
| 4,576,120 | 3/1986 | Ammann | 122/6 A |

*Primary Examiner*—Steven E. Warner
*Attorney, Agent, or Firm*—Kenyon & Kenyon

[57] ABSTRACT

The fossil-fuel fired vapor generator has a vertical flue formed of vertical tubes and a funnel at the bottom end which is formed by helically extending tubes. In addition, the helically extending tubes are in communication with the vertically extending flue tubes via bifurcation elements in order to convey the working medium upwardly into the flue tubes. The flue may be of rectangular cross-section with the funnel of similar shape or the flue may be of at least a pentagonal cross-section while the funnel has a rectangular outlet opening.

11 Claims, 2 Drawing Sheets

FOSSIL-FUEL FIRED VAPOR GENERATOR

This invention relates to a fossil-fuel fired vapor generator. More particularly, this invention relates to a fossil-fuel fired vapor generator having a vertical gas flue and a funnel disposed at the bottom end of the flue.

Vapor generators have been known to be constructed with a vertical gas flue and a funnel at the bottom end of the flue with both the flue and funnel being formed of tubes which are welded together in a gas-tight manner in order to convey a working medium therethrough. In one known vapor generator, the funnel tubes extend parallel to vertical planes while the gas flue also has vertically disposed tubes. This vapor generator is relatively simple to design and construct, particularly in the case of large vapor generator units. This is because the flue tubes can receive the vertical loadings, particularly the weight, without additional strengthening. Also, the gas flue may be connected very simply to the funnel. However, this vapor generator has a considerable disadvantage in that the temperature of the working medium issuing at the top end of the flue tubes varies very considerably since differences in the supply of heat in the funnel via the working medium during flow through the tubes are not equalized.

In the most common case of vapor generators having a rectangular cross-section gas flue and four funnel walls, endeavors have been made to compensate for the differences in the supply of heat between the middle wall zones and the corner zones by restricting the working medium in the relatively cool tubes of the corner zones. However, the restriction of the working medium has not only been very expensive but also causes pressure and power losses. In the case of vapor generators having a rectangular flue cross-section, it has been found that additional disturbances in the heat supply, for example, caused by soiling, cannot be readily compensated. Consequently, temperature differences of up to 160° C. may be operative at the end of the flue tubes.

A vapor generator is also known wherein the funnel tubes and flue tubes extend helically. In this construction, there is compensation for an uneven heat supply since the working medium flowing through the tubes passes through substantially all of the existing heat zones. However, this vapor generator has the disadvantage that design and manufacture are very costly since the helically extending flue tubes are often unable, unless strengthened, to carry the weight loading of the gas flue and of the funnel. Further, the cost increases as the size of the vapor generator increases.

Accordingly, it is an object of the invention to provide a vapor generator which is of relatively inexpensive construction and design.

It is another object of the invention to reduce the costs of constructing a vapor generator while obtaining a minimum of temperature differences of the working medium flowing through the vapor generator.

It is another object of the invention to provide a vapor generator in which there are minimal temperature differences in the working medium at gas flue tube exits even though the normal supply of heat may be disturbed.

Briefly, the invention provides a fossil-fuel fired vapor generator which is comprised of a vertical gas flue having a plurality of vertically extending tubes for conveying a working medium therethrough and a funnel at the bottom end of the gas flue which includes a plurality of helically extending tubes for conveying the working medium therethrough. In accordance with the invention, the helically extending tubes are in communication with the vertically extending tubes in order to convey the working medium therebetween. In this construction, the vertically tubed gas flue has all the design and production advantages of a completely vertically tubed vapor generator while the effect of the helically tubed funnel is, without incurring substantial design expenditure, that the entry temperature of the working medium into the flue tubes is equalized over the flue periphery.

As is known, the supply of heat in the funnel varies substantially due to slagging. Also, the heat distribution in the funnel on partial load depends upon the arrangement of the firing so that control of the resulting temperature distribution is possible only within limits. Therefore, the funnel is of relatively considerable significance insofar as heat supply disturbances are concerned.

A temperature disturbance at the beginning of a tube reacts, of course, mostly on the average specific volume of the working medium and, therefore, on the friction pressure drop. Variations in the temperature distribution are less in proportion as the distribution occurs geodetically higher. However, the vapor generator substantially neutralizes disturbances in the funnel such that friction pressure drops can be affected only by disturbances occurring above the funnel.

Because of the evening-out of the temperature at the entry of the gas flue tubes, the vapor generator also possesses another advantage in that only reduced restriction of the working medium in the cooler tubes is necessary. As a result, the pressure and power losses of the vapor generator remain small.

Normally, water flows in the zone of the funnel so that the friction pressure drops are insignificantly greater than in the corresponding vertically tubed funnel.

These and other objects and advantages of the invention will become more apparent from the following detailed description, taken in conjunction with the accompanying drawings wherein.

Figures 1, 2, 3:
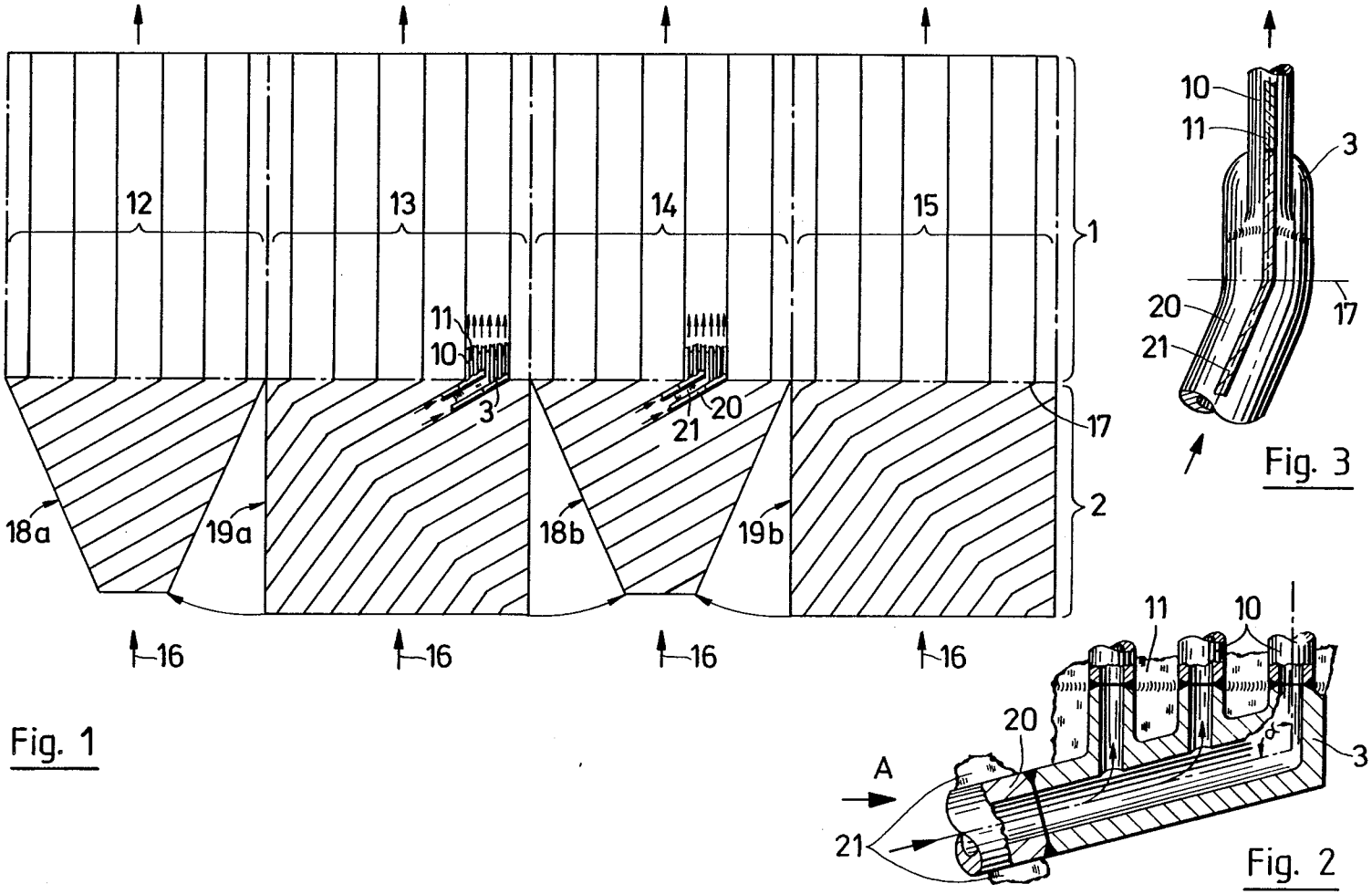
FIG. 1 illustrates a diagrammatic developed view of a gas flue and funnel of a square cross-section vapor generator according to the invention.
FIG. 2 illustrates a vertical sectional view through a connection between the funnel tubes and flue tubes of the vapor generator of FIG. 1.
FIG. 3 illustrates a view taken in the direction A of FIG. 2.

Referring to FIG. 1, the fossil-fuel fired vapor generator, for example a coal-dust-fired generator, includes a vertical gas flue 1 which is embodied by a plurality of vertical wall or bank tubes 10 which are welded together in gas-tight manner by way of webs 11 so as to form four equal vertical walls 12, 13, 14, 15 defining a rectangular flue passage. In addition, the vapor generator has a funnel 2 which is sealingly connected to the flue 1 at the bottom end and is also embodied by tubes 20 which are welded together in gas tight manner by way of webs 21. As indicated, the funnel tubes 20 extend helically throughout the funnel 2 and communicate with the wall tubes 10 in order to convey working medium therebetween.

As indicated by arrow 16, the working medium, for example, water, is fed into the funnel tubes 20 at the bottom and flows upwardly through the tubes 20 and thence through the wall tubes 10 upwardly as far as the exits thereof. During this time, the water evaporates by absorbing heat from the combustion of coal dust within the generator.

Each funnel tube 20 extends as far as a horizontal plane 17 which is shown in chain-dotted line in FIG. 1 and which separates the bottom end of the flue 1 from the funnel 2.

Referring to FIGS. 2 and 3, the top end of each tube 20 extends into a junction of bifurcation element 3 from which three wall tubes 10 branch.

As indicated in FIG. 1, the funnel 2 has two trapezoidal funnel walls 18*a*, 18*b* and two rectangular funnel walls 19*a*, 19*b* which are disposed in an alternating manner. The walls 18*a*, 18*b* extend parallel to one another and register with the flue walls 12, 14 whereas the rectangular walls 19*a*, 19*b* are disposed parallel to the inclined edges of the trapezoidal walls 18*a*, 18*b*, respectively and, thus, inclined inwardly of the gas flue 1. The walls of the funnel 2 thus define a narrowed horizontal outlet opening at the bottom which is smaller than the flue passage.

The funnel tubes 20 are of a greater diameter than the wall tubes 10. Hence, the funnel walls 18*a*, 18*b*, 19*a*, 19*b* can receive relatively heavy weights of ash. As shown in FIG. 2, the funnel tubes 20 include an angle $\alpha$ with the wall tubes 10 near the bifurcation elements 3 of from 100° to 130°. This included angle is as large as possible so that the length of each funnel wall is as long as possible. This results in boosting the satisfactory distribution of the heat uptake for each funnel tube 20. However, the angle has a bottom limit which is determined by thermodynamic and strength considerations of tube diameter and web width.

Figure 4:
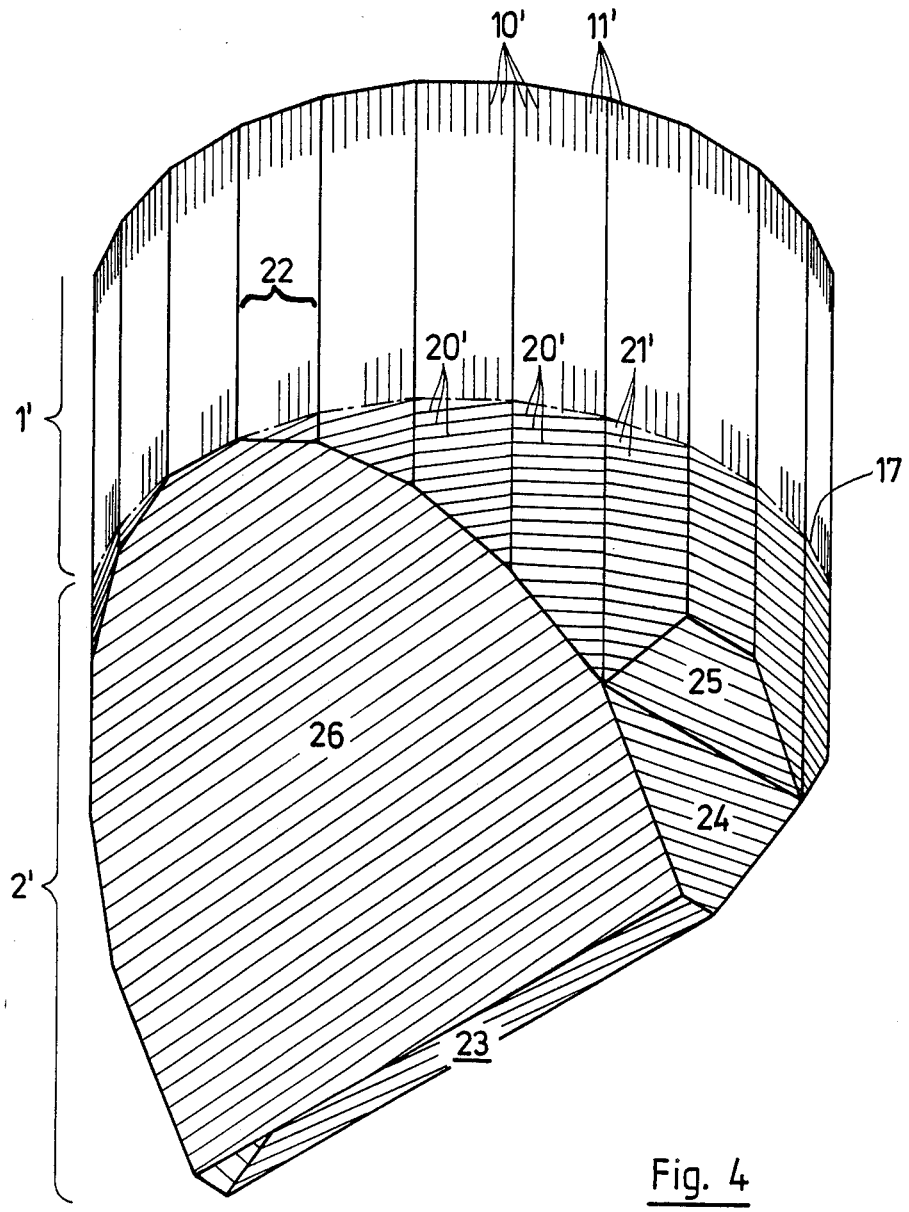
FIG. 4 illustrates a diagrammatic perspective view of a funnel and a part of a gas flue of a vapor generator having a twenty-four-sided gas flue in accordance with the invention.

Referring to FIG. 4, the vapor generator has a vertical gas flue 1' having twenty-four vertical walls 22 which are embodied by vertical tubes 10' and webs 11' welded therebetween. The funnel 2' is formed at the bottom with a horizontal outlet opening 23 in the shape of an elongated rectangle. As shown, the two short sides of the opening 23 are bounded by two vertical plane funnel walls 24 each of which merges at the top end into an inclined plane funnel wall 25. The two long sides of the outlet opening 23 are bounded by two inclined plane funnel walls 26.

As shown in FIG. 4, the respective funnel walls 25, 26 merge into intermediate walls at the upper edges while the intermediate walls merge into the flue walls 22 at the horizontal plane 17 which separates the flue 1' from the funnel 2'. As indicated, the horizontal plane 17 is disposed at the highest place of the funnel walls 26.

The funnel 2' is formed of helically extending tubes 20' which are welded together in gas-tight manner by way of webs 21'. The flue or bank tubes 10' and the funnel tubes 20' intercommunicate with each other and are flowed through upwardly by water or vapor.

In order to simplify production of the vapor generator shown in FIG. 4, every three consecutive vertical walls 22 in the bottom zone of the gas flue 1' merge by way of an inclined plane intermediate wall (equivalent to the inclined plane funnel wall 25) into a new and wider vertical wall. In this way, the number of sides in the helically tubed vertical part of the vapor generator is reduced from 24 to 8.

In the case of the vapor generator shown in FIG. 4, the differences between the heat stressing in the corner zones and the heat stressing in the wall centers is considerably less than in the case of the vapor generator illustrated in FIG. 1.

In an alternative construction, instead of having three flue tubes 10 branch off from a funnel tube 20, for example, one or five flue tubes may branch off from a funnel tube. Also, a number of funnel tubes can extend into one flue tube. Instead of using bifurcation elements 3, collectors can be used into which the flue tubes and funnel tubes extend and which are constructed as mixing collectors.

If tough ash arises in the combustion of fossil fuels, the webs 21, 21' can be disposed tangentially to the funnel tubes 20, 20', respectively on the inside of the funnel rather than as shown in FIG. 3. In this way, a very smooth sliding surface is presented to the ash.

Instead of having the plane of separation 17 between the funnel and the flue extend horizontally, the plane may extend obliquely to the axis of the flue.

The invention thus provides a vapor generator which can be simply constructed, particularly for large vapor generator units. In addition, the invention provides a vapor generator wherein there is a minimal amount of temperature variation in the working medium at the gas flue tube exits even where the normal supply of heat to the tubes may be disturbed.

The vapor generator may be constructed with a flue of rectangular cross section or of at least a pentagonal cross section with a rectangular funnel outlet opening.

What is claimed is:

1. A fossil-like fired vapor generator comprising:

a vertical gas flue including a plurality of vertically extending tubes extending throughout said flue for conveying a working medium therethorugh; and a funnel sealingly connected to a bottom end of said gas flue, said funnel including a plurality of helically extending tubes extending throughout said funnel for conveying the working medium therethrough, said helically extending tubes being in communication with said vertically extending tubes at said bottom end of said flue to convey the working medium therebetween, said funnel having two inclined walls bounding two long sides of a horizontal rectangular outlet opening at a bottom end of said funnel and two vertical plane walls bounding two short sides of said outlet opening.

2. A fossil-fuel fired vapor generator as set forth in claim 1 wherein said funnel tubes are of larger diameter than said flue tubes and wherein at least two flue tubes branch off from each funnel tube.

3. A fossil-fuel fired vapor generator as set forth in claim 1 wherein said funnel includes a pair of inclined plane walls, each said plane wall merging into a top edge of a respective vertical plane wall of said funnel.

4. A fossel-fuel fired vapor generator as set forth in claim 1 wherein said funnel tubes and said flue tubes define an included angle of from 100° to 130°.

5. A fossil-fuel fired vapor generator as set forth in claim 4 wherein said gas flue has at least a pentagonal cross-section.

6. A fossil-fuel fired vapor generator as set forth in claim 1 wherein said gas flue has at least a pentagonal cross-section.

7. A fossil-fuel fired vapor generator as set forth in claim 6 wherein said funnel includes a pair of inclined plane walls, each said plane wall merging into a top edge of a respective vertical plane wall of said funnel.

8. A fossil-fuel fired vapor generator comprising:

a vertical gas flue including a plurality of vertically extending tubes extending throughout said flue for conveying a working medium therethrough; and a funnel sealingly connected at a bottom end of said gas flue having two inclined walls bounding two long sides of a horizontal rectangular outlet opening at a bottom end of said funnel and two vertical plane walls bounding two short sides of said outlet opening, said funnel including a plurality of helically extending tubes extending from said outlet opening to said vertical tubes of said gas flue and being in communication with said vertically extending tubes at said bottom end of said flue to convey the working medium therebetween.

9. A fossil-fuel fired vapor generator as set forth in claim 8 wherein said funnel tubes are of larger diameter than said flue tubes and wherein at least two flue tubes branch off from each funnel tube.

10. A fossil-fuel fired vapor generator as set forth in claim 8 wherein said funnel includes a pair of inclined plane walls, each said plane wall merging into a top edge of a respective vertical plane wall of said funnel.

11. A fossil-like fired vapor generator comprising:

a vertical gas flue including a plurality of vertically extending tubes extending throughout said flue for conveying a working medium therethrough and a flue gas passage of rectangular cross-section; and a funnel sealingly connected to a bottom end of said gas flue, said funnel having a pair of vertical walls and a pair of inclined walls extending from said bottom end of said flue to define a flue gas passage of decreasing cross-sectional shape in a downward direction from said bottom end of said flue to an outlet opening at a bottom end of said funnel, said funnel having a plurality of helically extending tubes extending from said flue to said outlet opening for conveying the working medium therethrough, said helically extending tubes being connected directly to said vertically extending tubes at said bottom end of said flue to convey the working medium therebetween.

* * * * *

UNITED STATES PATENT AND TRADEMARK OFFICE

CERTIFICATE OF CORRECTION

PATENT NO. : 4,782,793

DATED : Nov. 8, 1988

INVENTOR(S) : ABDULLA SALEM

It is certified that error appears in the above-identified patent and that said Letters Patent is hereby corrected as shown below:

Column 3, line 15 "of" should be -or-
Column 4, line 35 "fossil-like" should be -fossil-fuel-
Column 6, line 5 "fossil-like" should be -fossil-fuel- Signed and Sealed this Second Day of May, 1989

*Attest:*

DONALD J. QUIGG

*Attesting Officer*

*Commissioner of Patents and Trademarks*